US005362260A

United States Patent [19]

Peloza

[11] Patent Number: 5,362,260

[45] Date of Patent: Nov. 8, 1994

[54] ELECTRICAL CONNECTOR WITH IMPROVED TERMINAL LATCHING SYSTEM

[75] Inventor: Kirk B. Peloza, Naperville, Ill.

[73] Assignee: Molex Incorporated, Lisle, Ill.

[21] Appl. No.: 111,822

[22] Filed: Aug. 3, 1993

[51] Int. Cl.[5] ..... H01R 13/432

[52] U.S. Cl. ..... 439/746; 439/872

[58] Field of Search ..... 439/749, 746, 747–749, 439/871, 872

[56] References Cited

U.S. PATENT DOCUMENTS

| | | | |
|---|---|---|---|
| 3,320,574 | 5/1967 | Tuchel | 339/217 |
| 3,753,193 | 8/1973 | Teagno et al. | 439/872 X |
| 4,043,631 | 8/1977 | Lapes | 439/872 X |
| 4,416,504 | 11/1983 | Sochor | 339/252 P |
| 4,531,808 | 7/1985 | Cairns et al. | 339/258 S |
| 4,979,912 | 12/1990 | Shindo et al. | 439/595 |

FOREIGN PATENT DOCUMENTS

| | | | |
|---|---|---|---|
| 091739 | 6/1968 | France | 439/749 |

*Primary Examiner*—Eugene F. Desmond
*Attorney, Agent, or Firm*—Stephen Z. Weiss

[57] ABSTRACT

A latching system for an electrical connector which includes a dielectric housing having a plurality of terminal-receiving cavities. A plurality of female terminals are adapted to be inserted into the cavities. Each terminal has a longitudinal axis and a mating portion adapted to mate with a male terminal also inserted into the cavity. At least one latch arm extends generally parallel to the longitudinal axis of the terminal with a slight angle of inclination convergent at the insertion end to hold the terminal in its cavity in the housing. The latch arm has opposite ends attached to the mating portion by flexible tabs. Each terminal-receiving cavity has a restricted cross-sectional area adapted to engage and bias the latch arm of a respective terminal transverse to the longitudinal axis of the terminal during insertion of the terminal into the cavity. A shoulder is provided adjacent the restricted cross-sectional area behind which one end of the latch arm snaps when the terminal is fully inserted into the cavity to prevent removal of the terminal from the cavity.

9 Claims, 2 Drawing Sheets

ELECTRICAL CONNECTOR WITH IMPROVED TERMINAL LATCHING SYSTEM

FIELD OF THE INVENTION

This invention generally relates to the art of electrical connectors and, particularly, to a latching system for holding terminals in cavities of a connector housing.

BACKGROUND OF THE INVENTION

A wide variety of mating electrical connectors employ pairs of interengaging pin and socket terminals for interconnecting a plurality of circuits or wires through the mated connectors. The pin and socket terminals often are called male and female terminals.

The terminals are mounted in a plurality of terminal-receiving cavities in a dielectric housing of the electrical connector. The terminals generally are elongated and are inserted into the cavities along the longitudinal axes of the terminals. Some form of latch means normally are provided to hold the terminals in the cavities against withdrawal therefrom.

Generally, there are two types of terminal latch means, and both types present various problems. First, the terminals often are provided with outwardly projecting, cantilevered flexible latch arms which snap behind shoulders within the terminal-receiving cavities of the connector housing. The cantilevered latch arms have a tendency to bend, break and/or snag on other parts. For instance, the latch arms may be bent or collapsed on a reel of interconnected terminals during shipping, prior to fabricating the connector. In addition, in order to have any significant latching capabilities, the latch arms must be of a sufficient width which often limits the width of the contact portions of the terminals and reduces the cross section area through which a current must pass which, in turn, causes over-heating.

Second, the connector housing may have plastic locking tabs which project into the terminal-receiving cavities for latching or locking behind more rigid shoulders on the terminals. Such latching systems are difficult to manufacture and may cause a myriad of problems, including but not limited to potential damages when removing a terminal from the connector housing during servicing, long term degradation due to temperature and humidity cycling, and difficulty in monitoring consistency from circuit-to-circuit or cavity-to-cavity. The plastic locking projections are weaker than metal latch arms. In addition, field servicing requires a stock or inventory of connector housings, because one defective locking projection results in discarding a complete connector housing, and housing replacement opens up the possibility of wiring errors.

This invention is directed to solving the above myriad of problems by providing a simple and reliable latching system for terminals in an electrical connector of the character described.

SUMMARY OF THE INVENTION

An object, therefore, of the invention is to provide a new and improved latching system or means for holding terminals in cavities of an electrical connector housing.

In the exemplary embodiment of the invention, an electrical connector is disclosed with a dielectric housing having a plurality of terminal-receiving cavities. A plurality of female terminals are adapted to be inserted into the cavities. Each terminal has a longitudinal axis and a mating portion adapted to mate with a male terminal also inserted into the cavity. Generally, latch means are provided to hold the terminals in the terminal-receiving cavities in the housing.

Specifically, the invention is directed to an improvement in the latch means for the terminals and includes at least one latch arm extending generally parallel to the longitudinal axis of the terminal. The latch arm has opposite ends attached to the mating portion of the female terminal by flexible tabs. Each of the terminal-receiving cavities has a restricted cross-sectional area adapted to engage and bias the latch arm of a respective terminal transverse to the longitudinal axis of the terminal during insertion of the terminal into the cavity. A shoulder is provided adjacent the restricted cross-sectional area behind which one end of the latch arm snaps when the terminal is fully inserted into the cavity, thereby preventing removal of the terminal from the cavity.

As disclosed herein, a pair of the latch arms are provided on the terminal in a side-by-side relationship extending generally parallel to the longitudinal axis of the terminal. The mating portion includes bottom wall means, opposite side wall means and top wall means. The latch arms and flexible tabs are provided in the top wall means. The female terminal is fabricated of stamped and formed sheet metal material, and the pair of latch arms are formed on opposite sides of a longitudinal open seam of the mating portion of the terminal.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
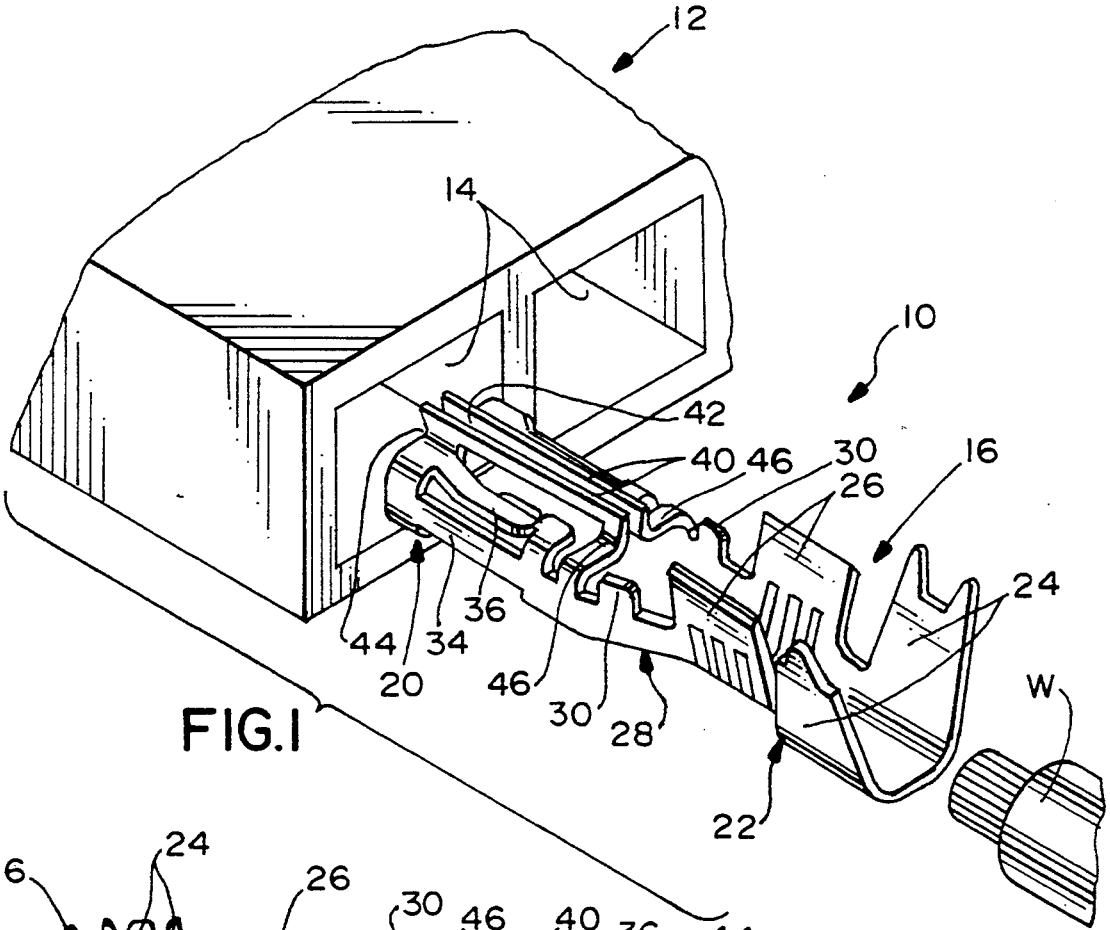
FIG. 1 is a perspective view of a female terminal and the connector housing, embodying the latching system of the invention.
Figure 4:
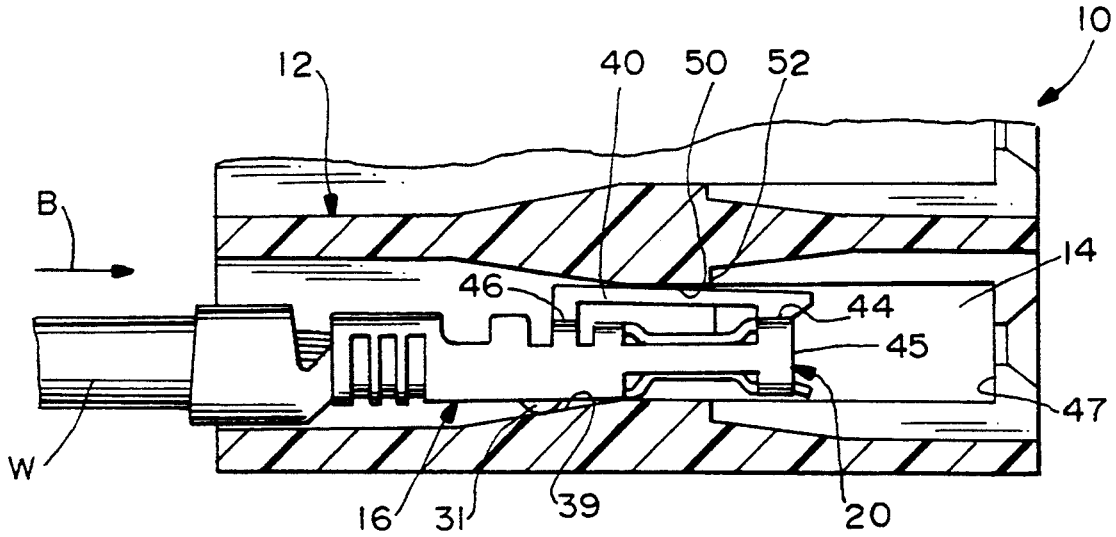
FIG. 4 is an axial section through the connector housing, showing the terminal terminated to an electrical wire, with the terminal partially inserted into a respective cavity in the housing.
Figure 5:
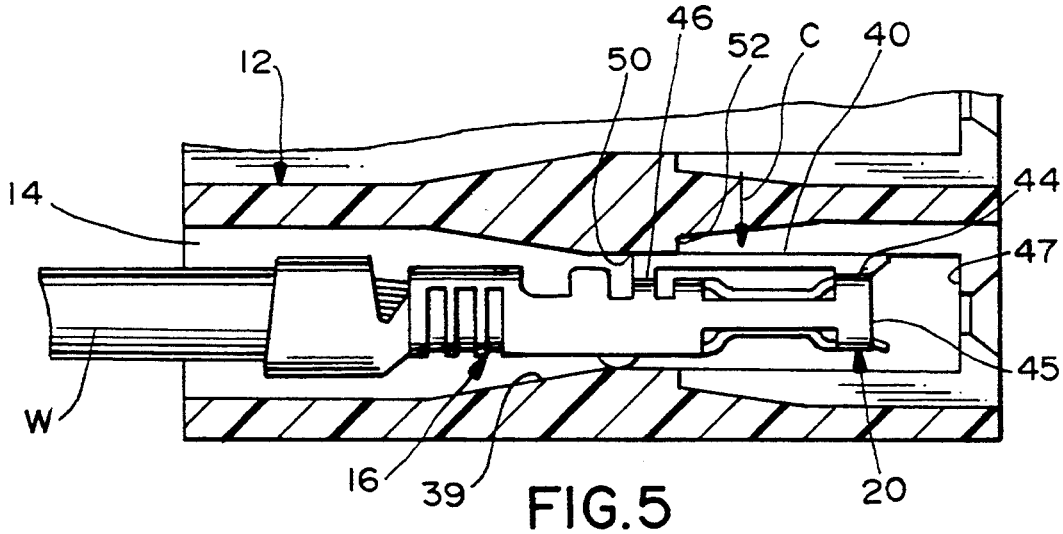
FIG. 5 is a view similar to that of FIG. 4, with the terminal further inserted into the cavity and showing the latch arms being biased inwardly by the restricted cross-sectional area of the cavity.
Figure 6:
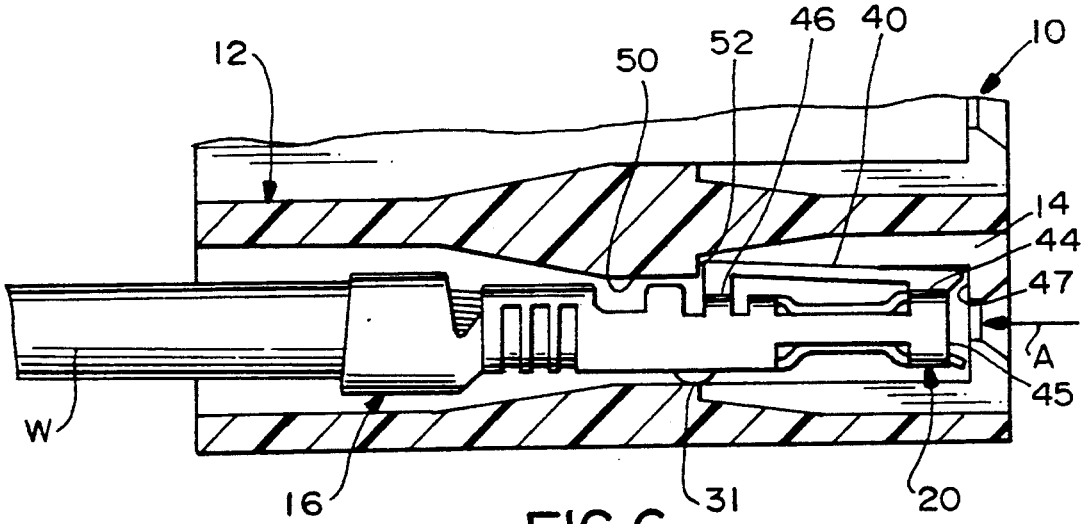
FIG. 6 is a view similar to that of FIGS. 4 and 5, with the terminal fully inserted into the cavity.

Referring to the drawings in greater detail, the latching system of the invention is incorporated in an electrical connector, generally designated 10 in FIGS. 1 and 4–6. Referring first to FIG. 1, the electrical connector includes a dielectric housing, generally designated 12, having a plurality of terminal-receiving cavities 14. A plurality of female terminals, generally designated 16, are adapted to be inserted into cavities 14. Each terminal has a longitudinal axis 18 and a mating portion, generally designated 20, adapted to mate with a male terminal (not shown) inserted into the cavity in the direction of arrow "A" (FIG. 6). Generally, the invention is directed to the provision of latch means to hold terminals 16 in the terminal-receiving cavities 14 of connector housing 12, as described in greater detail hereinafter. Although the invention is illustrated as embodied in a female terminal, the inventive concepts may have applications to other types of terminals.

Figure 2:
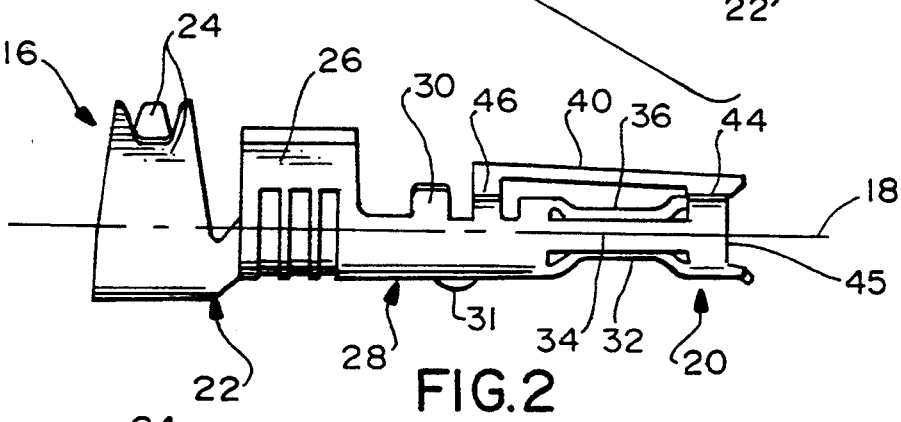
FIG. 2 is a side elevational view of the terminal.
Figure 3:
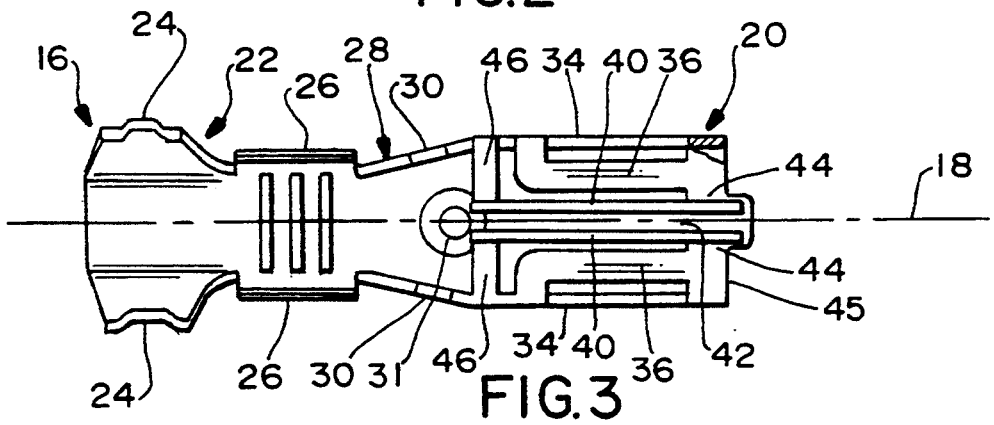
FIG. 3 is a top plan view of the terminal.

Referring to FIGS. 2 and 3 in conjunction with FIG. 1, each terminal 16 is stamped and formed from sheet metal material and is a female terminal in that mating portion 20 defines a receptacle for receiving a mating male terminal. The terminal is elongated, with mating portion 20 at one end and a terminating portion, generally designated 22, at an opposite end. The terminating portion includes two pairs of crimp arms 24 and 26 for terminating the terminal to an electrical wire. Crimp arms 24 are at the rear-most end of the terminal and are provided for crimping onto the outer insulation of an electrical wire. Inner crimp arms 26 are provided for crimping onto an exposed or stripped portion of the conductor core of the wire. The terminal includes an intermediate portion, generally designated 28, which forms a neck between mating portion 20 and terminating portion 22. The intermediate portion includes a pair of upwardly projecting tabs 30 and downwardly projecting dimple 31 which provide stabilization for the terminal within its respective cavity, and helps prevent rotation of the terminal about axis 18.

Mating portion 20 of each terminal 16 is generally rectangularly shaped as defined by bottom wall means 32, opposite side wall means 34 and top wall means 36. The side walls 34 are generally straight as seen best in FIGS. 1 and 3. The bottom and top wall means 32 and 36, respectively, are bent inwardly as best seen in FIGS. 1 and 2 and provide for resilient engagement of mating portion 20 with the male terminal.

The latching system or means of the invention includes a pair of latch arms 40 extending generally parallel to longitudinal axis 18 of the terminal. The latch arms are provided at the top wall of the terminal and have a slight angle of inclination which angle converges at the insertion end of the terminal. With the terminal being stamped and formed of sheet metal material, the latch arms may be conveniently provided on opposite sides of a longitudinal open seam 42 of the terminal at the mating end thereof. Opposite ends of the latch arms are attached at the mating portion of the terminal by front and rear flexible tabs 44 and 46, respectively. Therefore, the latch arms are capable of being flexed or biased inwardly, i.e. transverse to axis 18.

Referring to FIG. 4 in conjunction with FIG. 1, the latching system or means of the invention further includes a restricted cross-sectional area 50 in each terminal-receiving cavity 14, along with a shoulder 52 on the "far" side of the restricted cross-sectional area in relation to the insertion direction of the terminal as defined by arrow "B" in FIG. 4.

The operation of the latching system or means of the invention, along with the function of the above-described structure, now will be described in relation to FIGS. 4–6. More particularly, FIG. 4 shows one of the terminals 16 terminated to an electrical wire "W". The terminal is inserted into its respective cavity 14 in the direction of arrow "B". The terminals may be inserted individually into their respective cavities, or the terminals may be "gang" inserted into the cavities.

As the terminal is inserted into the cavity in the direction of arrow "B", the front ends of latch arms 40 at flexible tabs 44 will engage restricted cross-sectional area 50 and the dimple 31 will contact the lead in ramp 39 as shown in FIG. 4. The restricted area slightly biases the front ends of the latch arms inwardly in the direction of arrow "C". Continued insertion of the terminal will cause the rear ends of the latch arms 40 at flexible tabs 46 to bias to a greater extent in direction "C" than the front ends due to the slight angle of inclination to the latch arms 40 whereby the terminal can pass through the restricted area.

The terminal is at its fully inserted position when the rear of latch arms 40 at rear flexible tabs 46 clear restricted cross-sectional area 50, whereupon the rear ends of the latch arms snap behind shoulder 52 as the flexible tabs bias the latch arms transversely outwardly in the direction opposite of arrow "C" to their normal or unstressed condition. During insertion and in its fully inserted position, tabs 30 and dimple 31 provide stabilization of the terminal within the cavity. Shoulder 52 defines a stop for engagement by the rear ends of the latch arms to prevent the terminals from being pulled back out of the cavities opposite the direction of arrow "B". For servicing, a tool easily can be inserted into the front of a respective cavity 14 (i.e. in the direction of arrow "A" in FIG. 6), and bias the latch arms inwardly a sufficient distance to clear shoulder 52, whereby the terminal can be pulled or backed out of its respective cavity. If the terminal is inserted into cavity 14 beyond its fully inserted portion, the front edge 45 will contact the inner front wall 47 of the housing preventing the terminal from passing through the housing.

Flexible tabs 44 and 46 "close" the opposite ends of latch arms 40, contrary to the cantilevered latch arms of the prior art, making the latch arms 40 not as vulnerable to snagging, bending and breaking as with the cantilevered latch arms of the prior art. Latch arms 40, in essence, are an extension of the top wall means of the terminal and do not reduce the current-carrying cross-section of the terminal body, particularly the top, bottom and side wall means of the mating portion of the terminal. With flexible tabs 44 and 46 being provided at both ends of latch arms 40, the latch arms are provided with considerable support and are not likely to buckle.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. In an electrical connector which includes a dielectric housing having a plurality of terminal-receiving cavities, a plurality of female terminals adapted to be inserted into the cavities, each terminal having a longitudinal axis and a mating portion adapted to mate with a male terminal inserted into the cavity, and latching means to hold the terminals in the terminal-receiving cavities in the housing, wherein the improvement in said latching means comprises:

at least one latch arm extending generally parallel to the longitudinal axis of each terminal, the latch arm adapted to be biased in generally one direction having opposite ends attached to the mating portion of the female terminal by flexible tabs located in a plane generally perpendicular to said one direction; and each of said terminal-receiving cavities having a restricted cross-sectional area adapted to engage and bias the latch arm of a respective terminal transverse to the longitudinal axis of the terminal in said one direction during insertion of the terminal into the cavity, and a shoulder adjacent the restricted cross-sectional area behind which one end of the latch arm snaps when the terminal is fully inserted into the cavity to prevent removal of the terminal from the cavity.

2. In an electrical connector as set forth in claim 1, including a pair of said latch arms in a side-by-side relationship extending generally parallel to said longitudinal axis.

3. In an electrical connector as set forth in claim 2, wherein said mating portion includes bottom wall means, opposite side wall means and top wall means, and 4 said latch arms and flexible tabs are provided at the top wall means.

4. In an electrical connector which includes a dielectric housing having a plurality of terminal-receiving cavities, a plurality of female terminals adapted to be inserted into the cavities, each terminal having a longitudinal axis and a mating portion adapted to mate with a male terminal inserted into the cavity, and latching means to hold the terminals in the terminal-receiving cavities in the housing, wherein the improvement in said latching means comprises:

at least one latch arm extending generally parallel to the longitudinal axis of each terminal, the latch arm having opposite ends attached to the mating portion of the female terminal by flexible tabs;

each of said terminal-receiving cavities having a restricted cross-sectional area adapted to engage and bias the latch arm of a respective terminal transverse to the longitudinal axis of the terminal during insertion of the terminal into the cavity, a shoulder adjacent the restricted cross-sectional area behind which one end of the latch arm snaps when the terminal is fully inserted into the cavity to prevent removal of the terminal from the cavity; and said mating portion including bottom wall means, opposite side wall means and top wall means, and said latch arm and flexible tabs are provided at the top wall means.

5. In an electrical connector as set forth in claim 4, wherein the female terminal is fabricated of stamped and formed sheet metal material, and the pair of latch arms are formed on opposite sides of a longitudinal open seam of the mating portion of the terminal.

6. In an electrical connector as set forth in claim 4 including a pair of said latch arms in a side by side relationship extends generally parallel to said longitudinal axis.

7. An electrical terminal for insertion into a terminal-receiving cavity of a connector housing, the terminal fabricated of stamped and formed sheet metal material, being elongated and defining a longitudinal axis between a mating portion and a terminating portion, and latching means on the terminal to facilitate holding the terminal in its respective cavity in the housing, wherein the improvement in the latch means comprises:

a pair of latch arms extending generally parallel to the longitudinal axis of the terminal in a side by side relationship and formed on opposite sides of a longitudinal open seam of the terminal, and each latch arm having opposite ends attached to a portion of the terminal by flexible tabs, whereby the latch arms can be biased inwardly transverse to the longitudinal axis of the terminal during insertion of the terminal into its cavity and the latch arms can snap back outwardly to a latching condition, the flexible tabs at opposite ends of the latch arms otherwise preventing snagging of objects behind the latch arms.

8. In an electrical connector which includes a dielectric housing having a plurality of terminal-receiving cavities, a plurality of female terminals fabricated of stamped and formed sheet metal material, adapted to be inserted into the cavities, each terminal having a longitudinal axis and a mating portion adapted to mate with a male terminal inserted into the cavity, and latching means to hold the terminals in the terminal-receiving cavities in the housing, wherein the improvement in said latching means comprises:

a pair of latch arms extending generally parallel to the longitudinal axis of each terminal in a side by side relationship, the latch arms having opposite ends attached to the mating portion of the female terminal by flexible tabs are formed on opposite sides of a longitudinal open seam of the mating portion of the terminal; and each of said terminal-receiving cavities having a restricted cross-sectional area adapted to engage and bias the latch arm of a respective terminal transverse to the longitudinal axis of the terminal during insertion of the terminal into the cavity, a shoulder adjacent the restricted cross-sectional area behind which one end of the latch arm snaps when the terminal is fully inserted into the cavity to prevent removal of the terminal from the cavity.

9. An electrical terminal for insertion into a terminal-receiving cavity of a connector housing, the terminal being elongated and defining a longitudinal axis between a mating portion and terminating portion, and latching means on the terminal to facilitate holding the terminal in tis respective cavity in the housing, wherein the improvement in said latching means comprises:

at least one latch arms extending generally parallel to the longitudinal axis of the terminal, and the latch arms adapted to be biased in generally one direction having opposite ends attached to a portion of the terminal by flexible tabs located in a plane generally perpendicular to said one direction, whereby the latch arm can be biased inwardly transverse to the longitudinal axis of the terminal in said one direction during insertion of the terminal into its cavity and the latch arm can snap back outwardly to a latching condition, the flexible tabs at opposite ends of the latch arm otherwise preventing snagging of objects behind the latch arm.

* * * * *